United States Patent [19]

Vanis

[11] 4,264,032

[45] Apr. 28, 1981

[54] CURB-TO-DOOR MAIL RETRIEVER

[76] Inventor: Raymond B. Vanis, 411 4th St., David City, Nebr. 68632

[21] Appl. No.: 4,053

[22] Filed: Jan. 16, 1979

[51] Int. Cl.[3] ..... B65D 91/00

[52] U.S. Cl. ..... 232/39; 248/123.1

[58] Field of Search ..... 232/38, 39; 248/144, 248/145, 123.1, 130; 404/10; 256/1, 13.1

[56] References Cited

U.S. PATENT DOCUMENTS

| | | | |
|---|---|---|---|
| 1,326,791 | 12/1919 | Sensenbaugh | 232/39 X |
| 1,446,648 | 2/1923 | Kostlan | 248/123.1 X |
| 1,958,677 | 5/1934 | Phillips | 232/39 X |
| 2,898,066 | 8/1959 | Quellette | 248/145 |
| 3,790,773 | 2/1974 | Sapper | 248/123.1 X |

FOREIGN PATENT DOCUMENTS

| | | | |
|---|---|---|---|
| 236435 | 3/1964 | Austria | 404/10 |
| 460041 | 10/1949 | Canada | 232/39 |

*Primary Examiner*—Roy D. Frazier
*Assistant Examiner*—Peter A. Aschenbrenner
*Attorney, Agent, or Firm*—Harvey B. Jacobson

[57] ABSTRACT

The retriever comprises a hinged, foldable mailbox containing arm which is positioned in a vertical, folded upright position medially between the user's home and the position on a highway at which the mail delivery vehicle will stop. In the folded, upright position, the arm is locked. A release cord extends to the mail delivery position. A second release cord extends to the house. The locking mechanism may be released by tugging on one of the release cords at which time the arm will assume a horizontal extended position in the direction of the release cord. In this manner, the mailbox may selectively be positioned at the road or at the highway as desired. A return mechanism is also provided for returning the arm to its vertical, folded position.

2 Claims, 8 Drawing Figures

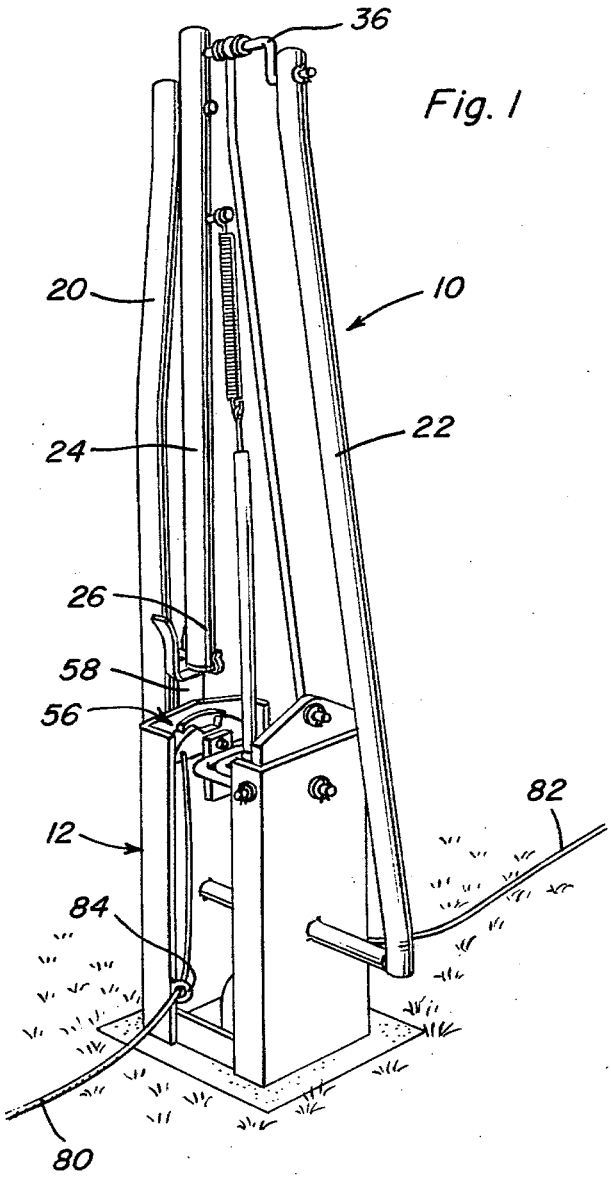
Fig. 1
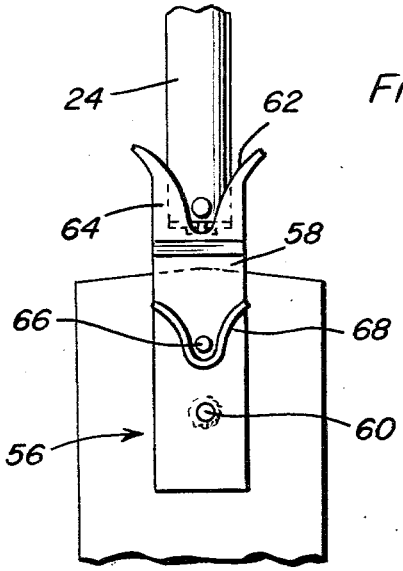
Fig. 6
Fig. 7
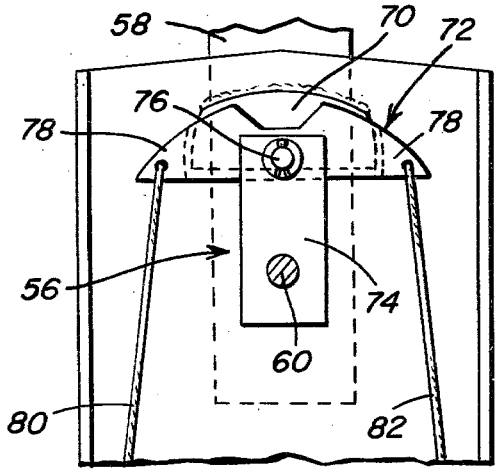
Fig. 8
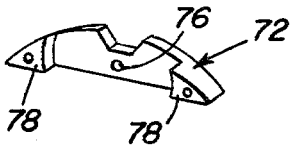
Fig. 2
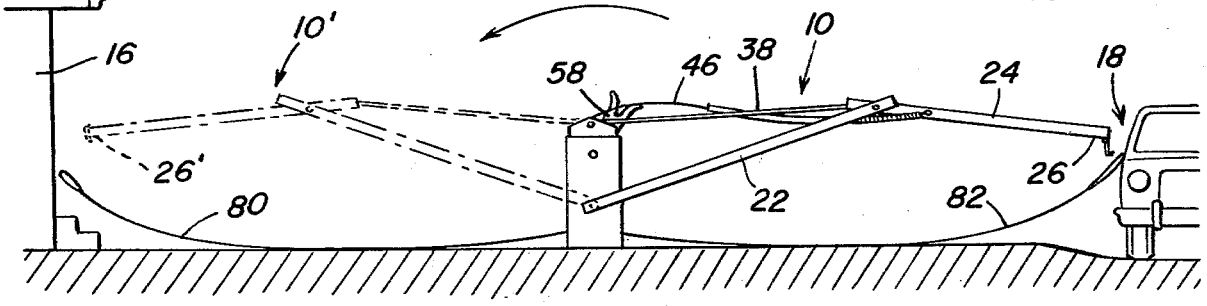

CURB-TO-DOOR MAIL RETRIEVER

BACKGROUND OF THE INVENTION

1. Field of the Invention

This invention relates to mailbox supports and especially movable mailbox supports for selectively positioning a mailbox at a mail delivery position or a mail receiving position.

2. Description of the Prior Art

Certain mailbox support structures which provide for the displacement of the mail containing box prior to and subsequent to the delivery of mail include U.S. Pat. No. 1,326,791, issued Dec. 30, 1919 to Sensenbaugh. The Sensenbaugh device employs a pivotal mailbox containing arm operated through a cam and lever arrangement. The mailbox containing arm is attached to a transverse support member having a spiral slot incorporated therein. The cam is attached to the lever and is disposed through that slot and, when moved longitudinally of the shaft, causes the shaft to rotate with the attached mailbox arm thereby being displaced. U.S. Pat. No. 1,725,693, issued Aug. 20, 1929 to Arledge shows a mailbox hanger wherein a mailbox is slidably attached to a longitudinally extending pivoted arm. When the arm is pivoted, and thus disposed in an inclined position, the mailbox slides therealong and thus is displaced from its initial position either toward or away from the mail delivery position depending on the angular inclination of the rod. U.S. Pat. No. 1,958,677, issued May 25, 1934 to Phillips shows a mailbox holder wherein a mailbox is attached in a surmounting position to a parallelepiped arragement. The mailbox may be moved forward and backward by virtue of pivots at each corner of the parallelepiped. In this manner, the mailbox may be displaced whle maintaining a constant level disposition. U.S. Pat. No. 2,898,066, issued Aug. 4, 1959 to Ouelette shows a rural mailbox which is capable of attaining a position at a convenient height for a person to place mail therein and a second vertically displaced position above the traffic on the highway. The box may also swing horizontally from a position at right angles to the highway into a position more or less parallel with the highway.

SUMMARY OF THE INVENTION

The main object of the present invention is to provide a curb to door mail retrieval system which will allow delivery of mail directly to one's front door without the necessity of either the the postman or the mail patron having to personally traverse the distance between the front door of the house and the mail delivery position on the sidewalk or street. In this manner, mail may be delivered without fear of injury to either party due to the existence of ice, snow, toys, dogs and the like which may prove to be hazardous to one traversing such distance.

Another object of the present invention is to provide a mail retrieval device which can also be used as a support for a flag, yard light, basketball hoop or other like object when the device is in its neutral position.

One additional object of the present invention is to provide a mail retrieval device which incorporates a folding mailbox containing arm which may be extended in a horizontal position on either side of a support base.

Yet a still further object of the present invention is to provide a mail retrieval device which may be positively locked in a vertical, folded neutral position wherein the device provides a minimal obstruction in the area of its use.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the mail retrieval device of the present invention in its neutral position.

FIG. 2 is an elevational view of the device shown in its horizontal, extended position.

FIG. 6 is an elevational view taken substantially along a plane passing through section line 6—6 of FIG. 3 showing the pin and notch locking mechanism of the invention.

FIG. 7 is an elevational view taken substantially along a plane passing through section line 7—7 of FIG. 3 showing the eccentric cam locking arrangement of the invention.

FIG. 8 is a perspective view of the cam lock of FIG. 7.

DESCRIPTION OF THE PREFERRED EMBODIMENT

Figure 3:
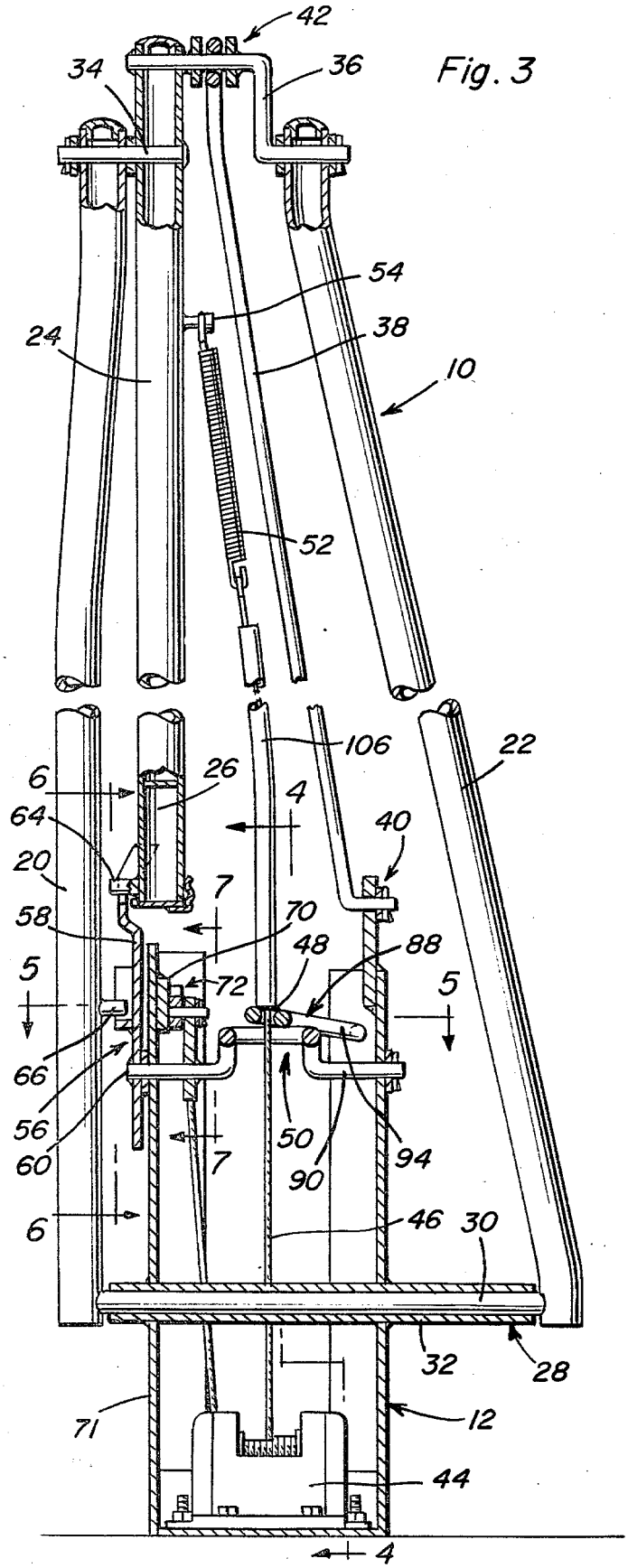
FIG. 3 is an elevational part sectional view of the mail retrieval device.

Now with reference to the drawings, the curb-to-door mail retrieval device generally labelled by the numeral 10 will be set forth in detail. With reference to FIGS. 1 and 2 of the drawings, it will be seen that the device consists of a base member 12 which rests upon, preferably, a concrete slab 14 which is set in the ground medially between a house 16 and a mail delivery position designated as 18. As shown in FIG. 1, the device is in its neutral position with support arms 20 and 22 vertically extending from the base member 12 and the pivot arm 24 maintained in a dependent position from the support arms. From the neutral position, the arms may be either extended in a horizontal orientation toward the mail delivery position 18 as shown at 10 in FIG. 2 or in a horizontal position extended toward the house 16 as shown in phantom at 10' in FIG. 2. The end of pivotal arm 24 has incorporated therein the actual mailbox 26. Thus, with the arm extended toward the mail delivery position, the mailbox is disposed at a convenient height for mail delivery by a mailman. Similarly, when the pivot arm is extended toward house 16, the mailbox shown in phantom at 26' is also disposed at a convenient level for the retrieval of the mail therefrom by the postal patron.

Now with reference to FIGS. 1-3, the pivoting mechanism of the present invention will be clearly described. Support arms 20 and 22 are firmly affixed to a common horizontal oscillating pole hinge 28 which comprises cylindrical bar 30 which is firmly affixed to supports 22 and 24 and is rotatably journaled in collar 32. Collar 32 is in turn firmly affixed to the base 12. Accordingly, the support arms 22 and 24 together with bar 30 may pivot as a unit about the collar 32. At the opposite end of each support arm 20 and 22, there is provided a hinge joint for the support of pivot arm 24. Support arm 20 is connected directly to the pivot arm by pivot pin 34 which is affixed to the pivot arm 24 at a position spaced from the end of the pivot arm. Pivot pin 34 extends through the support arm 20 and is rotatable therein. An offset pivot pin 36 is rotatably journaled in the support arm 22 and firmly affixed to the end of pivot arm 24. The rotatable ends of pins 34 and 36 are aligned with one another such that pivot arm 24 may rotate about an axis defined by the pivot pin ends. A pivot link 38 is rotatably mounted at 40 to the top of base 12. The opposite end of pivot link 38 is rotatable journaled to the offset of pin 36 at a position laterally spaced from the end of pivot arm 24 and labelled 42. In this manner, as the support arms 20 and 22 rotate about the pole hinge 28, pivot arm 24 is forced to rotate about the pivot pins 34 and 36 by the pivot link 38 until the pivot arm 34 is in substantial alignment with the pivot link 38 at which time the mailbox 26 is displaced to the desired position. In this position, as seen in FIG. 2, the pivot link 38 supports pivot arm 24 and the support arms 20 and 22.

Figure 4:
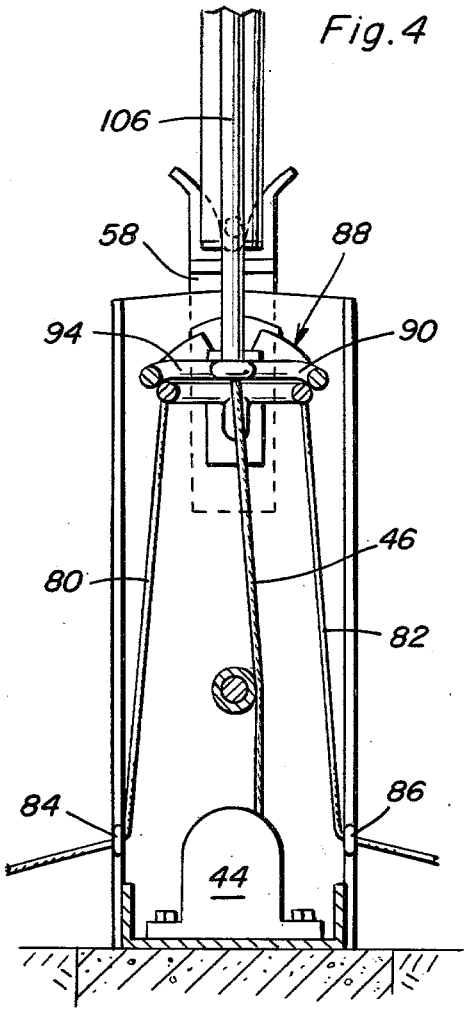
FIG. 4 is an elevational sectional view of the device taken substantially along a plane passing through section line 4—4 of FIG. 3.

As seen in FIGS. 3 and 4, a winch 44 is included in the base portion 12 for returning the mailbox to the neutral position. Winch 44 includes rope 46 which is wound therearound. Rope 46 extends from the winch through eye 48 of neutral positioning mechanism 50 and is connected at its opposite end to spring 52 which is in turn connected to pivot arm 24 at a position longitudinally displaced from the offset of pin 36 and on the opposite side of the pivot point defined by pin 34. As shown in FIG. 3, the spring 52 may be connected by use of a laterally extending tab 54 connected to the pivot arm 24. It will be noted that eyelet 48 is spaced vertically below pivot connection 40 of the pivot link 38. Consequently, when the winch 44 is activated, the rope 46 pulls at tab 54 through spring 52 thus forcing pivot arm 24 to swing back around its pivot connection and assume its original vertical position.

In order to hold the mechanism in the vertical, neutral position, a locking mechanism generally designated by the numeral 56 and shown in FIGS. 1, 3, 6 and 7 is employed. Locking mechanism 56 includes a neutral position arm 58 which is pivotally mounted to the base member at pivot point 60. The neutral position arm 58 has a V notch 62 in the top thereof for retaining neutral position pin 64 attached to the mailbox and of pivot arm 24. A second V notch 68 is disposed medially of the arm 58 and accepts a second neutral position pin 66 which is attached to support arm 20. When maintained in a vertical position, neutral position arm 58 inhibits pivot arm 24 and support arm 20 from being displaced from the vertical position and thus locks these elements in the vertical, neutral position. A cam 70, as most clearly seen in FIGS. 3 and 7 provides the mechanism whereby arm 58 is maintained in its vertical position. Cam 70 is fixedly attached to the interior of wall 71 of housing 12. Cam 70 coacts with cam 72 to prevent rotational translation of lever arm 74. Lever arm 74 is rotatably affixed through pivot point 60 to neutral position arm 58 and rotates therewith. Cam 72 is rotatably affixed to the end of lever arm 74 at point 76 as clearly seen in FIG. 7 and indicated in FIG. 8. Cam 72 has two dogs 78 which extend laterally of the cam 72 in an abutting position with cam 70. If a force is applied to neutral position arm 58, for example, by one of the pins 64 or 68, one or other of the dogs 78 will abut with cam 70 whereby inhibiting any rotational translation of the arm 58 and maintaining the device in its neutral position.

In order to release the locking mechanism 56 to allow the retrieval device to extend in its horizontal position, two cords 80 and 82 are attached to opposite ends of cam 72. These cords extend downward from cam 72 and pass through eyelets 84 and 86 as seen in FIGS. 1, 3 and 4. The cords then extend respectively to the house and mail delivery position as seen in FIG. 2. Again, with reference to FIG. 7, it can be seen that when one of the cords is placed in tension, the cam 78 rotates about point 76. If for instance cord 80 is pulled, the dog 78 attached to cord 80 will move downwardly while dog 78 opposite cord 80 will move upwardly above the topmost position of cam 70. Upon a continued tension being applied to cord 80, lever arm 74 will also rotate as neither dog 78 is now in a position to contact cam 70. Rotation of lever cam 74 in turn rotates neutral position arm 58 which releases pins 64 and 66 and sets the arms 20, 22 and 24 in motion. In this instance, with cord being pulled the weight of the arms would be shifted toward house 16 whereupon the arms would be extended until limited by pivot link 38 at which time mailbox would be positioned proximate to the house. Alternatively, if cord 82 were pulled, the weight of the device would be shifted oppositely and the mailbox would be positioned as shown in FIG. 2 proximate the mail delivery position.

Figure 5:
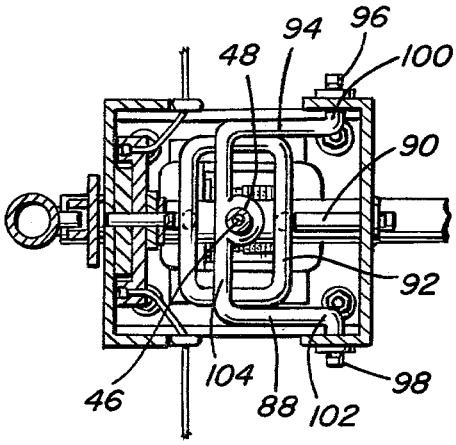
FIG. 5 is a plan sectional view taken substantially along a plane passing through section line 5—5 of FIG. 3.

When winch 44 is activated to reposition the device in the neutral position, the neutral position arm 58 is tilted in the direction of the extension of pivot arm 24 in order to accept pins 64 and 66. As the device reaches the neutral position, the positive positioning apparatus 88 shown in FIGS. 3, 4 and 5 is actuated. Apparatus 88 includes neutral position arm shaft 90 which extends through base 12 and is pivotally attached thereto at its ends, with one end of the shaft 90 forming pivot pin 60. Located centrally of shaft 90 is an enlarged opening defined by hoop portion 92. It will be immediately evident that when neutral position arm 58 is in a vertical orientation, the hoop 92 of neutral position shaft 90 lies in a horizontal plane. Upon rotation of the neutral position arm 58, the hoop 92 will take on a disposition angularly oriented with respect to a horizontal plane. Located immediately above the neutral position shaft 90 and resting upon hoop 92 is quadrant 94. Quadrant 94 is pivotally connected to the base 12 at points 96 and 98. Quadrant 94 includes legs 100 and 102 together with bight portion 104. Bight portion 104 contains eye 48 through which rope 46 extends as discussed herein above. The bight portion 104 of the quadrant rests directly on hoop 92 and the quadrant 94 is pivoted about points 96 and 98 by angular movement of hoop 92 when the neutral position arm 58 is rotated away from the vertical. Thus, it will be clear that when the device is in an extended position, as, for example, the position shown in FIG. 2, the neutral position arm 58 will be angled toward the extended arm 24 and one edge of hoop 92 will be raised thus pivoting quadrant 94 upward. Upon activation of winch 44, rope 46 will pull arm 24 back toward the vertical. Pins 64 and 66 will enter respectively notches 62 and 68 and at the same time sleeve 106, which is disposed about rope 46 and has an outside diameter greater than the internal diameter of eye 48, will engage eye 48. At this point, further tensioning of the rope 46 by winch 44 will cause spring 52 to extend and will also cause sleeve 106 to force quadrant 94 downwardly upon hoop 92 thereby causing a rotation of the hoop until that hoop is realigned with the horizontal. Rotation of the hoop 92 will rotate neutral position arm 58 until that position arm is perfectly vertical. Upon position arm 58 attaining a vertical position, the dog 78 of cam 72 as shown in FIG. 7 will snap into position on either side of cam 70 thus locking the arm 58 into vertical position. At this point, the power to winch 44 may be removed either by a manual switch or a limit switch located on the device itself. With the power to the winch removed, the device is ready to be activated once again by pulling of either cord 80 or cord 82. It will be noted that the switch for initiating operation of winch 44 may include a switch located in the house 16, or a switch located at position 18 such that either the postal patron or the mailman may make the winch operative to turn the device to its neutral position.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mailbox support device comprising:

a base;

a first support arm having two ends, with one end being pivotally attached to said base;

mailbox support means attached to the opposite end of said first support arm for carrying a mailbox;

latching means for holding said first support arm in a vertical position including a positioning arm pivotally attached to said base and engageable with said first support arm, a cam lock means for locking said positioning arm into a predetermined orientation whereby said positioning arm engages said first support arm for constraining said first support arm for moving about its pivot axis;

release means for selectively releasing said latching means such that said first support arm pivots in either a first direction or a second direction; and a neutral positioning means for returning said first support arm to the vertical position after being released by said release means.

2. The device of claim 1 wherein the cam lock means includes a first cam member fixedly attached to said base, a second cam member pivotally attached at a point spaced from the pivotal attachment of said positioning arm and connected for rotation with said positioning arm.

* * * * *